United States Patent [19]

Sanchez

[11] Patent Number: 4,995,167

[45] Date of Patent: Feb. 26, 1991

[54] MASONRY GUIDE

[76] Inventor: William Sanchez, 303 Smith St., Clio, Mich. 48420

[21] Appl. No.: 328,403

[22] Filed: Mar. 24, 1989

[51] Int. Cl.[5] ..... G01C 15/10

[52] U.S. Cl. ..... 33/404; 33/406

[58] Field of Search ..... 33/404, 405, 406, 407, 33/408, 409, 410

[56] References Cited

U.S. PATENT DOCUMENTS

| | | | |
|---|---|---|---|
| 441,492 | 11/1890 | Kelley | 33/410 |
| 1,004,194 | 9/1911 | Platt | 33/406 |
| 1,060,284 | 4/1913 | Platt | 33/410 |
| 1,878,448 | 9/1932 | Cornuelle | 33/404 |
| 2,616,180 | 11/1952 | Parker | 33/408 |
| 2,788,579 | 4/1957 | Mills | 33/406 |
| 3,063,152 | 11/1962 | Colbert | 33/406 |
| 4,144,649 | 3/1979 | Huston | 33/409 |
| 4,285,139 | 8/1981 | Huston | 33/407 |
| 4,443,954 | 4/1984 | Clark | 33/404 |

*Primary Examiner*—William A. Cuchlinski, Jr.

*Assistant Examiner*—C. W. Fulton

*Attorney, Agent, or Firm*—William D. Blackman; Arnold S. Weintraub

[57] ABSTRACT

A novel masonry tool kit that enables masons to plumb their work quickly and easily which saves time and money. The invention consists of two vertical members or story poles which operate in two systems. One system is used for outside corners and the other for inside corners. The vertical members or story poles have markings to save time so brick courses will be pregauged which prevents uneven courses on the wall. The lower L shaped members give stability so that the masonry line can be pulled tight and true with no movement. The masonry guide provides a simplified method of insuring accuracy with quality craftsmanship in masonry work. This masonry tool kit eliminates the need to shim or build a lead at the top of the foundation inside or outside corners as the lower L shaped members secure the vertical member or story pole in the correct position.

20 Claims, 3 Drawing Sheets

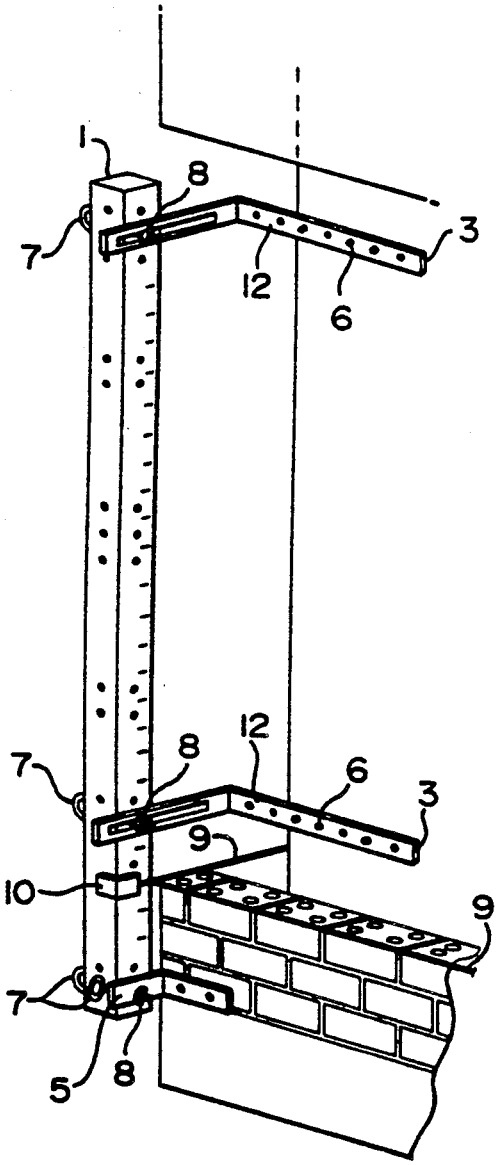
FIG 1
FIG 2
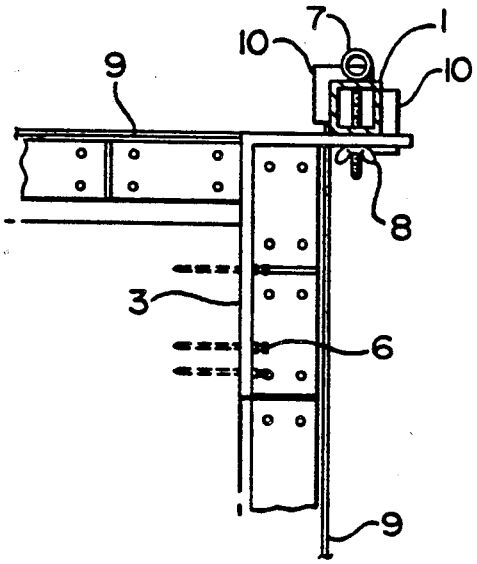
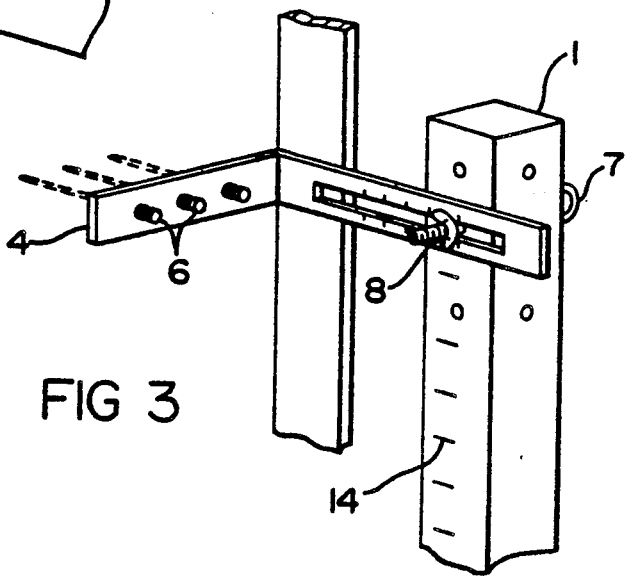
FIG 3

FIG 7
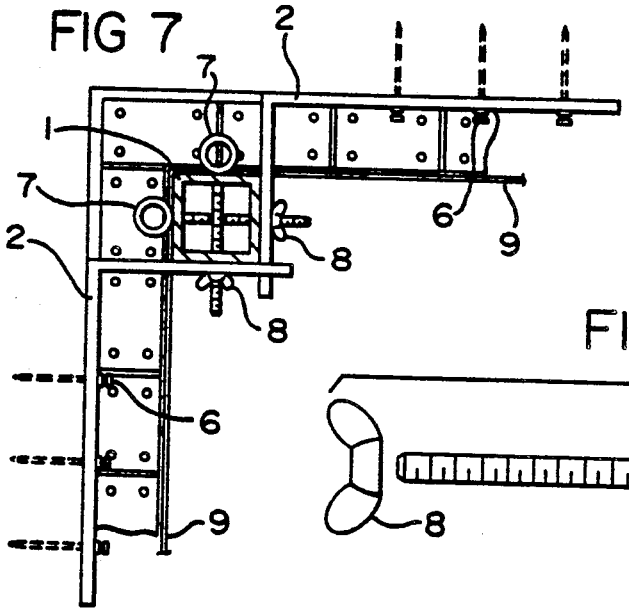
FIG 8
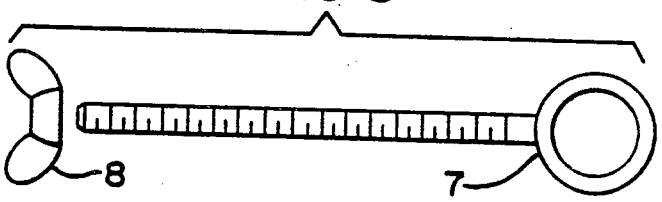
FIG 9
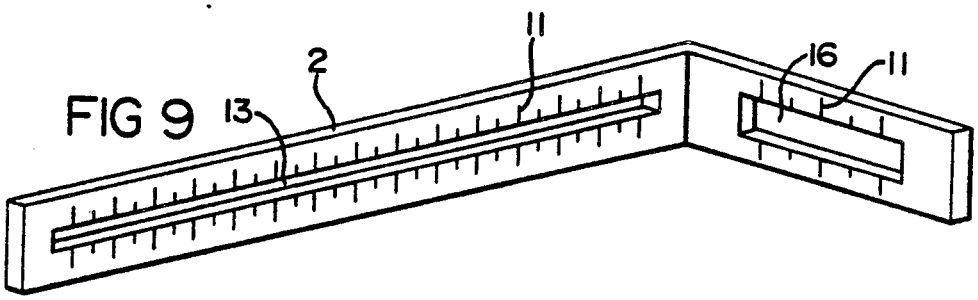
FIG 10
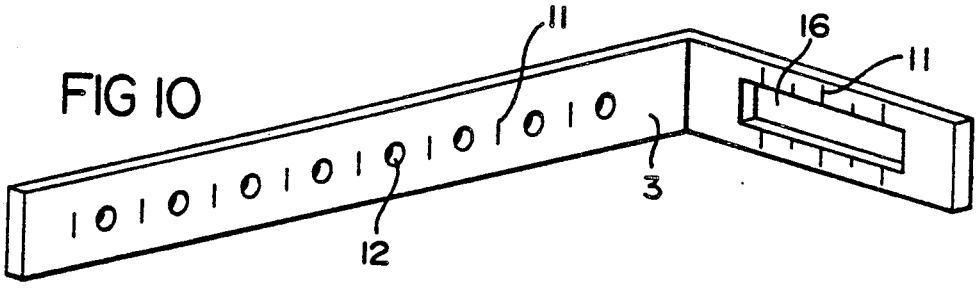
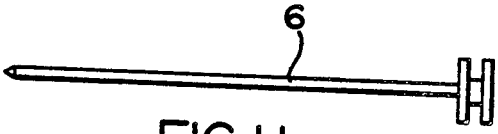
FIG 11

MASONRY GUIDE

CROSS-REFERENCES TO RELATED APPLICATIONS: NONE

STATEMENT AS TO RIGHT TO INVENTIONS MADE UNDER FEDERALLY SPONSORED RESEARCH AND DEVELOPMENT: NOT APPLICABLE.

BACKGROUND OF THE INVENTION

The field of the invention is generally that of masonry guides and more specifically to new and useful improvements to corner devices for accurately laying brick or block courses.

Many masonry guides in the past have tried to improve the conventional method of frequent plumbing and leveling each course of masonry as a building proceeds.

Because the many adjustments needed for vertically and horizontally, experienced masons that these complicated systems are not cost effective unless they are building an unusually large building. Experienced masons find that in home construction, it is easier to build up corners and then lay each course of bricks or blocks. If the foundation is not in the correct position, then shimming or building a lead is required which is time consuming and often does not locate the story pole in the correct position.

The present invention simplifies the complicated and time consuming set-up time of masonry guides and creates a device that is cost effective to use in home and small building construction. This invention eliminates the need to shim or build a lead at the top of the foundation inside or outside corners as the lower bracket members secure the vertical member or story pole in the correct position.

SUMMARY OF THE INVENTION

Generally speaking, the present invention comprises a novel masonry tool kit that enables masons to plumb their work quickly and easily. This masonry tool kit eliminates the need to shim or build a lead at the top of the foundation inside or outside corners as the lower members secure the vertical member in the correct position.

The difference between the present invention and others is that the bottom L shaped members, or brackets automatically give the distance between the wall and the masonry line. No shimming or building a lead is necessary. The system give more stability so that a mason line can be pulled tight and true with no movement. The system is installed quickly and saves time and money with quality craftsmanship.

The invention consists of two vertical members or story poles which operate in two systems. One system is used for outside corners and the other for inside corners. The vertical members automatically give the distance between the wall and the masonry line. The brackets are attached to both members, which have measurement, to determine distance, between the wall and the masonry line.

It is an object of the present invention to provide a novel way to do a quality mason job with less chance of error.

It is a further object of the invention to provide a novel tools for masons that can be set-up and transported easily.

It is a further object of the invention to provide a simplified method of insuring accuracy in masonry work.

It is a further object of the invention that what makes this different is that the vertical members bottom brackets enables stability, height, distance for a more accurate corner. Your will never have to shimmy or build a lead.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

BRIEF DESCRIPTION OF THE DRAWING

FIG. 1 is a three-dimensional perspective view showing one exemplary embodiment of one representative form of the masonry outside corner device.

FIG. 2 is a plan view showing one exemplary embodiment of one representative form of the masonry outside corner device.

FIG. 3 is a three-dimensional perspective view showing one exemplary embodiment of one representative form of the masonry outside corner device.

FIG. 7 is a plan view showing one exemplary embodiment of one representative form of the masonry inside corner device.

FIG. 8 is a three-dimensional perspective view showing one exemplary embodiment of one representative form of the masonry eye bolt and wing nut.

FIG. 9 is a three-dimensional perspective view showing one exemplary embodiment of one representative form of the masonry L shaped mounting bracket having slots.

FIG. 10 is a three-dimensional perspective view showing one exemplary embodiment of one representative form of the masonry L shaped mounting bracket having holes and a slot.

FIG. 11 is a elevation view showing one exemplary embodiment of one representative form of the masonry two headed nail.

DESCRIPTION OF THE PREFERRED EMBODIMENTS

Figure 4:
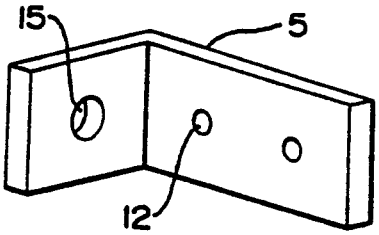
FIG. 4 is a three-dimensional perspective view showing one exemplary embodiment of one representative form of the masonry L shaped foot bracket having holes.

The masonry guide enables mason to plumb their work quickly and easily. It provides an effective way to do a quality mason job with less chance of error.

Referring to FIG. 1, the device consists of at least one vertical member 1 sometimes called a story pole. Vertical member 1 has measuring graduations on a vertical face thereof that automatically give the distance between a course of bricks or blocks. Vertical member 1 is a steel tubular member, however, other materials such as aluminum could also be used. Vertical member 1 has holes perpendicular to longitudinal axis for mounting L shaped member 2, 3, 4, or 5. For an outside corner, two L shaped members, or attachment brackets, 3 are attached to the vertical member 1 with eye bolt 7 and wing nut 8. When the brick courses reach lower L shaped member 3, L shaped member or foot bracket 5 (FIG. 4) is installed with eye bolt 7 and wing nut 8 through hole 15, and then nail 6 is inserted through hole 12 and nailed to a lower mortar joint. Most of the time it is not necessary to nail L shaped member 5, as vertical member 1 will be held in place by masonry line 9. Then L shaped member 3 is removed so that bricking can continue.

In FIG. 3, L shaped member 4 (FIG. 5) is attached to the vertical member 1 with eye bolt 7 and wing nut 8. The L shaped member 4 is attached to the wall of a structure using a double headed nail 6.

Referring to FIG. 2, masonry line 9 is attached to vertical member 1 with line block 10.

In FIG. 4, L shaped member 5 has hole 15 for attaching to vertical member 1 and holes 12 for attaching to the wall of a structure.

Figure 5:
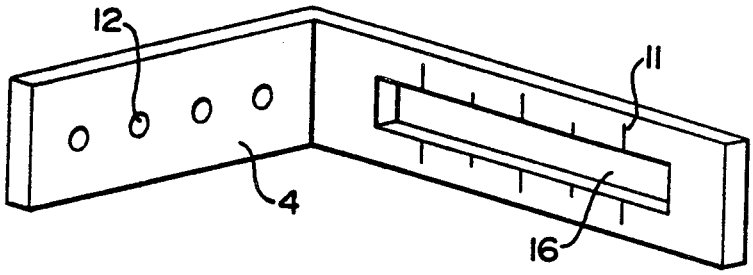
FIG. 5 is a three-dimensional perspective view showing one exemplary embodiment of one representative form of the masonry L shaped mounting bracket having holes and a slot.

In FIG. 5, L shaped member 4 has slot 16 for attaching to vertical member 1 and holes 12 for attaching to the wall of a structure.

In FIG. 9, L shaped member 2 has slot 16 for attaching to vertical member 1 and slot 13 for attaching to the wall of a structure.

In FIG. 10, L shaped member 3 has slot 16 for attaching to vertical member 1 and holes 12 for attaching to the wall of a structure.

Figure 6:
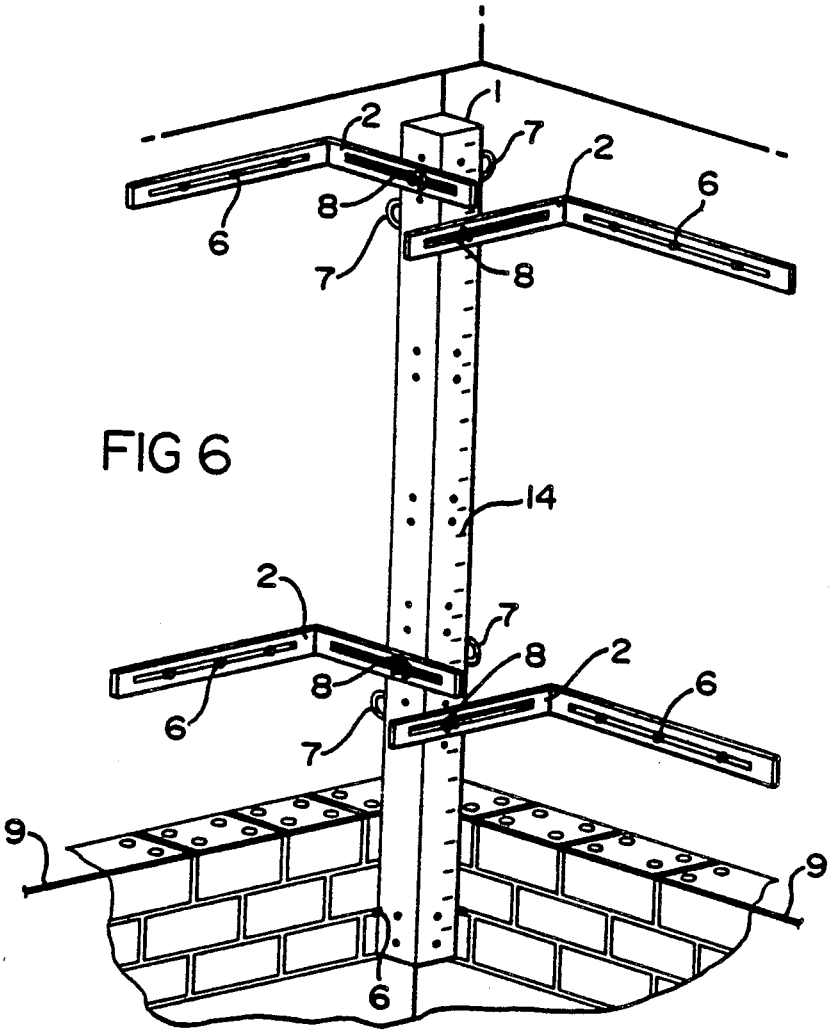
FIG. 6 is a three-dimensional perspective view showing one exemplary embodiment of one representative form of the masonry inside corner device.

In FIG. 6, an inside corner, L shaped member, or attachment bracket 2 has two slots for adjustment purposes. Nail 6 is inserted through the narrow slot 13 in member 2 (FIG. 9) so that member 2 can be secured to a stud in the building. Eye bolt 7 (FIG. 8) is inserted through the wide slot 16 in member 2. L shaped member 3 (FIG. 10) has one slot 16 for mounting to vertical member 1 and holes 12 that can be used for nailing to the wall of a building or structure. L shaped member 4 (FIG. 5) has one slot 16 for mounting to vertical member 1 and holes 12 that can be used for nailing to the wall of a building or structure. L shaped member 5 (FIG. 4) has a hole 15 for mounting to vertical member 1 and holes 12 that can be used for nailing to the wall of a building or structure.

Nail 6 (FIG. 11) is used to attached L shaped bracket 2,3,4, or 5 to the wall of a building or structure. Nail 6 has two heads so that nail 6 can be pulled out easily when removing the device from the building or structure. Also, nail 6 will not damage or bend L shaped bracket 2,3,4, or 5 when removing L shaped bracket 2,3,4, or 5 from the wall of the structure.

Eye bolt 7 is used to attach L shaped bracket 2,3,4, or 5 to vertical member 1. Eye bolt 7 is inserted through vertical member 1 and then through L shaped bracket 2, or 3, or 4, or 5 and then wing nut 8 is turned until the connection is secure.

For outside corners (FIG. 1) of a building or structure two L shaped members 3 are attached to the building surface or structure. By using one L shaped members 3 on the top and one L shaped members 3 on the bottom, the proper distance between the wall and the masonry line is maintained. The first L shaped member 3 is located near the top of the building and the second is located near the bottom of the building or structure and by using gauge marks 11 (FIG. 10) set to the same numbers will give the correct distance between the wall and masonry line and also will be plumb. Similar mounting is done at other corners of the building or structure and then masonry line 9 is connected to vertical members 1 with line block 10.

For inside corners (FIG. 6) of a building or structure four L shaped members 2 are attached to the building surface or structure. By using two L shaped members 2 on the top and two L shaped members 2 on the bottom, and by using gauge marks 11 (FIG. 9) set to the same numbers will give the proper distance between the wall and the masonry line and also will be plumb. The first and second L shaped members 2 are located near the top of the building and the third and fourth are located near the bottom of the building or structure. Then vertical member 1 is connected to L shaped members 2 by using eye bolt 7 and wing nut 8. When the course of blocks or bricks reach lower L shaped member 2, lower L shaped member 2 is removed and vertical member 1 is secured by nailing at the bottom of vertical member 1 so that vertical member 1 is wedged into the inside corner.

Similar mounting is done at other corners of the building or structure and then masonry line 9 is connected to vertical members 1 with line block 10.

It should be understood that the figures and the specific description thereof set forth in this application are for the purpose of illustrating the present invention and are not to be construed as limiting the present invention to the precise and detailed specific structures shown in the drawing figures and specifically described hereinbefore. Rather, the real invention is intended to include substantially equivalent constructions embodying the basic teachings and inventive concept of the present invention.

What is claimed is:

1. A masonry guide for a building comprising:

(a) at least one vertical member having a first vertical face;

(b) at least two L shaped attachment brackets each having a first portion 90 degrees from a second portion thereof, the longitudinal axes of said portions being coplanar;

(c) means for connecting each first portion of each attachment bracket to the vertical member on the fast first vertical face thereof;

(d) means for attaching the second portion of each attachment bracket to a first surface of the building;

(e) an L shaped foot bracket having a first portion 90 degrees from a second portion thereof, the longitudinal axis of the portions being coplanar;

(f) means for attaching the L shaped foot bracket to the first vertical face of the vertical member.

2. The masonry guide of claim 1 wherein the means for attaching the first portion of each attachment bracket to the vertical member is releasable from the bracket and the vertical member.

3. The masonry guide of claim 1 wherein the means for attaching the first portion of each attachment bracket to the vertical member comprises:

(a) at least one perforation in the bracket first portion;

(b) a throughhole formed in the vertical member;

(c) a bolt passing through the bracket perforation and the vertical member throughhole;

(d) a nut attached to the bolt for securing the vertical member and the bracket to prevent relative motion therebetween.

4. The masonry guide of claim 1 wherein each attachment bracket first portion has an elongated slot formed therethrough.

5. The masonry guide of claim 1 wherein each attachment bracket first portion has gauge marks thereon.

6. The masonry guide of claim 5 wherein the attachment bracket second portion has gauge marks thereon.

7. The masonry guide of claim 1 wherein attachment bracket second portion has gauge marks thereon.

8. The masonry guide of claim 1 wherein each attachment bracket second portion has at least one perforation therethrough for use in securing the second portion to the building.

9. The masonry guide of claim 8 wherein the perforation is an elongated slot.

10. The masonry guide of claim 1 further comprising means for attaching the foot bracket to a masonry surface parallel to the first surface of the building.

11. A masonry guide for a building comprising:

(a) at least one vertical tubular member having adjustment holes and a first vertical face;

(b) at least two L shaped attachment brackets each having a first portion with an adjustment slot, said first portion 90 degrees from a second portion, the second portion having an adjustment slot;

(c) means for connecting each first portion of the attachment brackets to the vertical member on the first vertical face thereof;

(d) means for attaching each second portion of the attachment brackets to a first surface of the building;

(e) an L shaped foot bracket having a first portion 90 degrees from a second portion thereof, the longitudinal axis of the portions being coplanar;

(f) means for attaching the L shaped member to the first vertical face of the vertical member.

12. The masonry guide of claim 11 wherein the means for attaching the first portion of each attachment bracket to the vertical member is releasable from the bracket and the vertical member.

13. The masonry guide of claim 11 wherein the means for attaching the first portion of each attachment bracket to the vertical member comprises:

(a) at least one perforation in the bracket first portion;

(b) a throughhole formed in the vertical member;

(c) a bolt passing through the bracket perforation and the vertical member throughhole; and, (d) a nut attached to the bolt, for securing the vertical member and the bracket to prevent relative motion therebetween.

14. The masonry guide of claim 11 wherein each attachment bracket first portion has an elongated slot formed therethrough.

15. The masonry guide of claim 11 wherein each attachment bracket first portion has gauge marks thereon.

16. The masonry guide of claim 15 wherein attachment bracket second portion has gauge marks thereon.

17. The masonry guide of claim 11 wherein attachment bracket second portion has gauge marks thereon.

18. The masonry guide of claim 11 wherein each attachment bracket second portion has at least one perforation therethrough for use in securing the second portion to the building.

19. The masonry guide of claim 18 wherein the perforation is an elongated slot.

20. The masonry guide of claim 11 further comprising means for attaching the foot bracket to a masonry surface parallel to the first surface of the building.

* * * * *